US005805531A

United States Patent [19]

Schäfer

[11] Patent Number: 5,805,531

[45] Date of Patent: Sep. 8, 1998

[54] WATCH IN PARTICULAR WRISTWATCH

[75] Inventor: Roy Schäfer, Karlsruhe, Germany

[73] Assignee: Erich Lacher Uhrenfabrik GmbH & Co. KG, Pforzheim, Germany

[21] Appl. No.: 859,355

[22] Filed: May 20, 1997

[51] Int. Cl.[6] ..... G04B 19/00; G04B 19/06

[52] U.S. Cl. ..... 368/76; 368/223

[58] Field of Search ..... 368/76, 80, 155–157, 368/179, 223, 228, 229, 285

[56] References Cited

U.S. PATENT DOCUMENTS

| | | | |
|---|---|---|---|
| 4,723,232 | 2/1988 | Beebe | 368/76 |
| 4,839,874 | 6/1989 | Namisato | 368/76 |
| 4,899,324 | 2/1990 | Barbieri et al. | 368/76 |

*Primary Examiner*—Vit W. Miska
*Attorney, Agent, or Firm*—Pillsbury Madison & Sutro

[57] ABSTRACT

A watch composed of at least one guide element, at least one time indicator element, and a dial interposed between the at least one guide element and the at least one time indicator element. The at least one guide element is movable as a function of time and the at least one time indicator element is magnetically coupled to the at least one guide element for movement with the at least one guide element to provide a detectable time indication. The watch is further provided with a cage space for maintaining the at least one time indicator element secure against loss, and the magnetic coupling between the at least one time indicator element and the at least one guide element extends over at least a partial area of the cage space.

10 Claims, 5 Drawing Sheets

WATCH IN PARTICULAR WRISTWATCH

BACKGROUND OF THE INVENTION

The present invention relates to a watch, in particular a wristwatch, having at least one time indicator element, which is disposed above a dial, to provide a time indication by means of magnetic reciprocal interaction with at least one guide element disposed under the dial.

Such watches, wherein the movement of the time indicator element is accomplished in a magnetic or electromagnetic manner, are known, for example, from German Patent Publications DE 75 14 640 U, DE 84 34 517 U and DE 93 02 267 U.

The function of the watches described therein essentially rests on that the movement of magnets maintained on hands of the watch takes place through a dial by means of a corresponding number of time indicator elements. The problems inherent in this solution essentially lie in the magnitude of the magnetic interactions between the time indicator elements on the one hand and the hands associated with them, particularly if several time indicator elements are employed for hours and minutes, respectively.

Regardless of how the strength of magnetic coupling between the time indicator element and the hands is selected, there is always the danger that a time indicator element will come off the dial or the disk provided for this, either under the effect of an outside force, for example a shock, or under the effect of a magnet assigned to another time indicator element, there inevitably being a reciprocal movement of the hands past each other, when the hands are "on top" of each other. In either case the actual function of the watch, the reading of time, is lost, since the time indicator elements either come completely off the dial or an erroneous association between the time indicator elements and guide elements results.

The employment of the technical teachings disclosed in the above mentioned references of the prior art is therefore not possible, especially in connection with small watches, particularly wristwatches, since because of the inevitable closeness of the time indicator elements on the one hand and of the relatively weak magnetic coupling, already structurally necessitated, on the other hand, a dependable function of a wristwatch in accordance with the structural principles of the prior art is not assured.

BRIEF SUMMARY OF THE INVENTION

It is therefore an object of the invention to provide a novel watch of the type described above, in particular a wristwatch, in which the time indicating function of the watch is always assured or at least can be easily restored.

The above and other objects are attained in accordance with the invention by a watch composed of at least one guide element, at least one time indicator element, and a dial interposed between the at least one guide element and the at least one time indicator element. The at least one guide element is movable as a function of time and the at least one time indicator element is magnetically coupled to the at least one guide element for movement with the at least one guide element to provide a detectable time indication. The watch is further provided with a cage space for maintaining the at least one time indicator element secure against loss, and the magnetic coupling between the at least one time indicator element and the at least one guide element extends over at least a partial area of the cage space.

Thus, the basic idea of the invention lies in assigning a cage space to each time indicator element, which cage space is assigned exclusively to that time indicator element in which that time indicator element is maintained assured against loss and in which the reciprocal interaction between that time indicator element and its assigned guide element takes place, so that an overlap between the individual cage spaces on the one hand and the magnetic reciprocal interaction field on the other hand is assured, which guarantees that a correct time display is always assured if the time indicator element is only brought into the area of the greatest reciprocal interaction with its associated guide element, which will be the case directly above this guide element, and in this way indicates the time.

It is possible by means of a suitable magnitude of the magnetic reciprocal interaction to deliberately bring about this interaction for increasing the optical effect, in that the electromagnetic coupling between the time indicator element and the guide element lies within the order of magnitude of other exterior forces acting on the time indicator element in its cage space, i.e. in particular gravity or inertial forces caused by movements of the wristwatch on the wrist of the user.

In accordance with a particularly advantageous embodiment there is therefore the possibility that under the changing effects of these forces the time indicator element can change selectively between a time indicating position and a free movement position within its cage space, wherein these two states of the time indicator element can be caused at any time by an external action of the user, so that the useful value of the watch beyond its actual time indicating purpose (time indicating position) is supplemented by a decorative, entertainment or design purpose (free movement position), wherein the movements of the time indicator element are provided by the effects of the mechanical or electromechanical forces acting on it, which result in particular movement effects of a time indicator element, and this considerably increases the esthetic attraction of the watch.

The assignment of the time indicator elements to individual cage spaces which are localized in respect to each other, then also easily makes possible the use of two time indicator elements, in particular as minute and hour hands, because the cage spaces can be assigned to the movement spaces of the guide elements in such a way that the unequivocal assignment of a time indicator element to a guide element and thus the correct display of the time information remains assured under any conditions or can be regained simply.

A further particularly advantageous embodiment of the concept of the invention provides that the cage space of at least one time indicator element is in the shape of an annular conduit that is open at the top, wherein the diameter of this annular conduit corresponds to the diameter of the circular path of the guide element. Although a certain limitation of the free movement space of the time indicator element in its free movement position must be accepted because of this, since only circular path movements are possible, it can be achieved by a suitable cross-sectional design of the cage space that the time indicator element projects out of the cage space and can therefore be tactilely sensed there. Together with suitable profilings or other markings in the area of the cage space and/or at the case rim or the case cover, this further development in particular permits the production of wristwatches for blind people, wherein here the special attraction is also maintained, namely the change between the time indicating position and the free movement position of the time indicator element, which in this case can be sensed by blind people and therefore can also be determined.

Further advantageous embodiment options and designs will become apparent from the description to be presented below.

Several exemplary embodiments of the invention will now be described in detail with reference to the drawings.

DETAILED DESCRIPTION OF THE INVENTION

Figure 1:
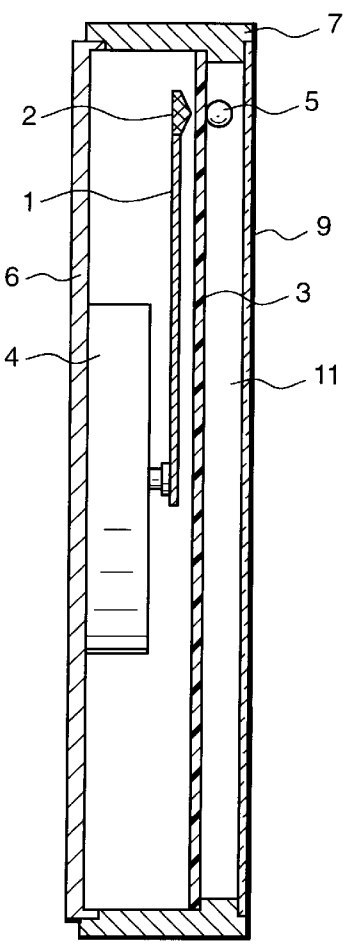
FIG. 1 cross section through a watch in the plane 1—1 of FIG. 2.

FIG. 1 shows a section 1—1 through a watch, in particular a wristwatch, with a movement 4, preferably a quartz movement, which is provided with a rotatable arm 1 disposed underneath a dial 3 made of a magnetically permeable material, such as a plastic. An indicator element 5 rests on top of dial 3 and is held in position by means of magnetic attraction to a guide element 2, which is permanently magnetic or magnetized or reacts to magnetism or can be magnetized in an electromagnetic manner and is located in the arm 1. In spite of this magnetic attraction, indicator element 5 is capable of being freed from the fixed position relative to guide element 2 and to move freely in a cage space 11 which is at its disposal. Cage space 11 is delimited by dial 3, a portion of the side wall, or case, 7 of the watch and a transparent watch glass, or crystal, 9. If the time indicator element 5, after having left the fixed position, comes back into the vicinity of guide element 2 and if the kinetic energy of the time indicator element 5 is less than the magnetic attraction of the guide element 2, the time indicator element will return into its time indicating position and the time can then be read. The magnitude of the coupling forces can be varied by selection of the field strength of the magnets, the selection of the material and the distance between the coupling partners, i.e. between guide element 2 and indicator element 5.

The movement 4 is fastened on a back cover 6 of the wristwatch. The guide element 2 has a tip, for example. However, in place of this a permanent magnet ring, which is diametral, or arcuate, and is seated with its center bore on the end of the arm 1, can also be used as guide element. By means of this a local maximum of magnetism is achieved and a precise return of the free time indicator element 5 to the correct time indicating point is achieved. The time indicator element 5 can consist of a multitude of bodies (for example iron filings), which take up a magnetic coupling with the guide element 2 located under the dial 3.

Figure 2:
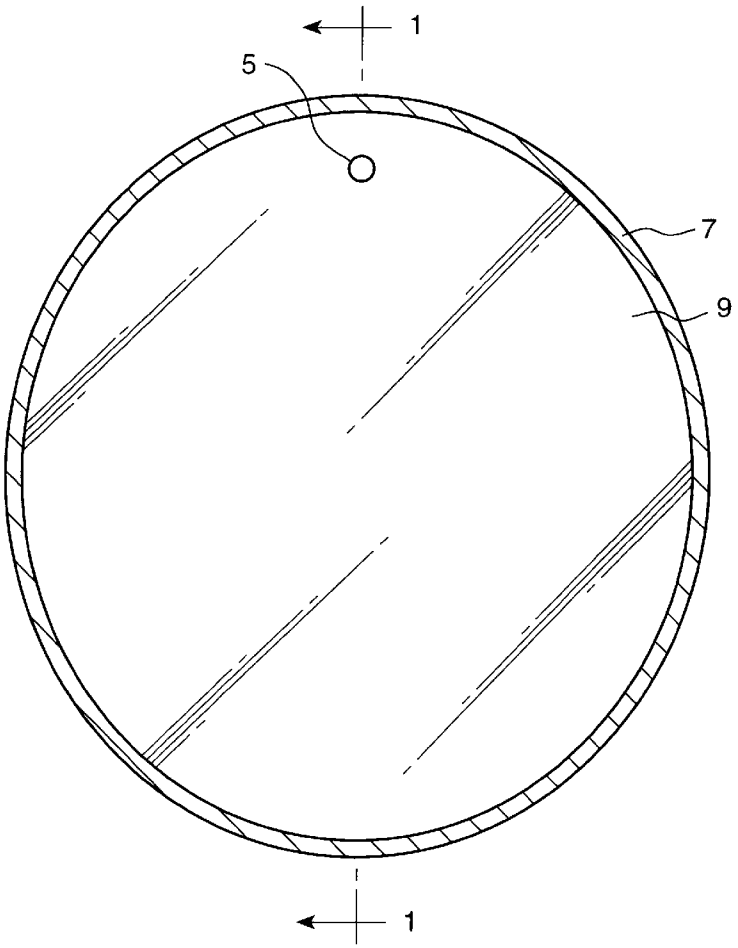
FIG. 2 is a top view of the watch in FIG. 1.
Figure 3:
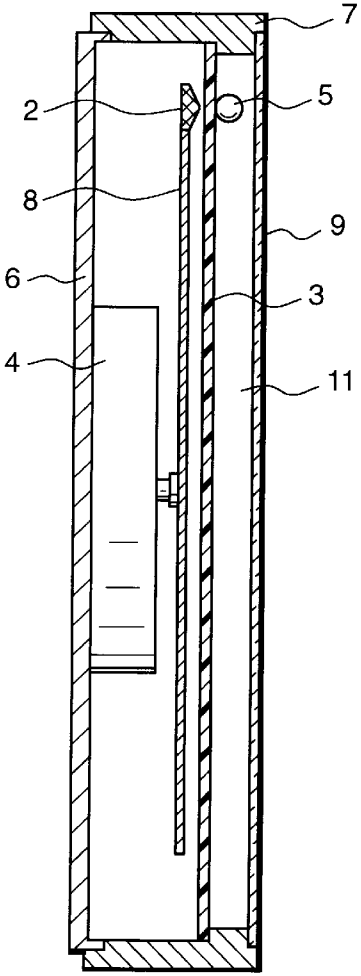
FIG. 3 is a sectional view of a second exemplary embodiment of a watch.

FIG. 3 shows an exemplary embodiment which differs from that of FIGS. 1 and 2 only in that a disk 8 is used in place of an arm 1.

Figure 4:
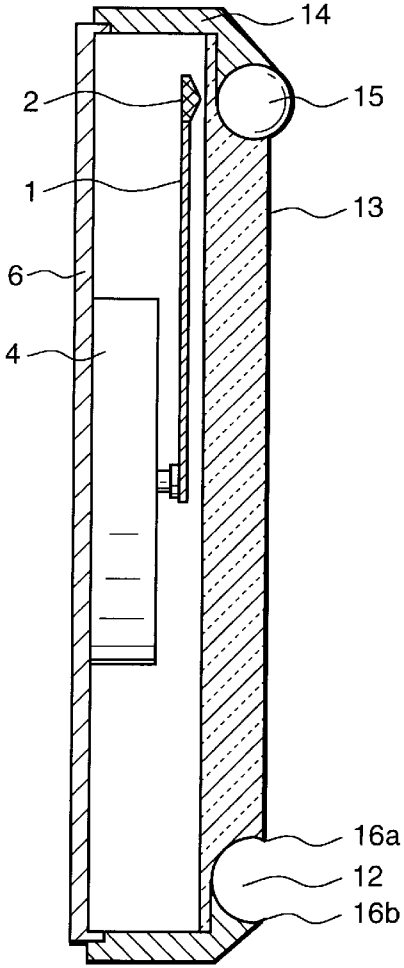
FIG. 4 is a sectional view of a third exemplary embodiment of a watch with a time indicator element which can be felt.

FIG. 4 shows a further exemplary embodiment in which the watch case is divided into a first case element 13 and a second case element 14. Elements 13 and 14 together delimit a ring-shaped cage space 12 in which the time indicator element 15 is located. Elements 13 and 14 have edges 16*a* and 16*b*, respectively, which are separated from one another by a distance which is less than the maximum transverse dimension of the time indicator element 15. Therefore, time indicator element 15 cannot leave the cage space 12. Graphic markings for time periods and/or markings which can be felt can be provided on one or both of the case elements 13 and 14.

A possible use can be found in the field of watches for the blind.

Figure 5:
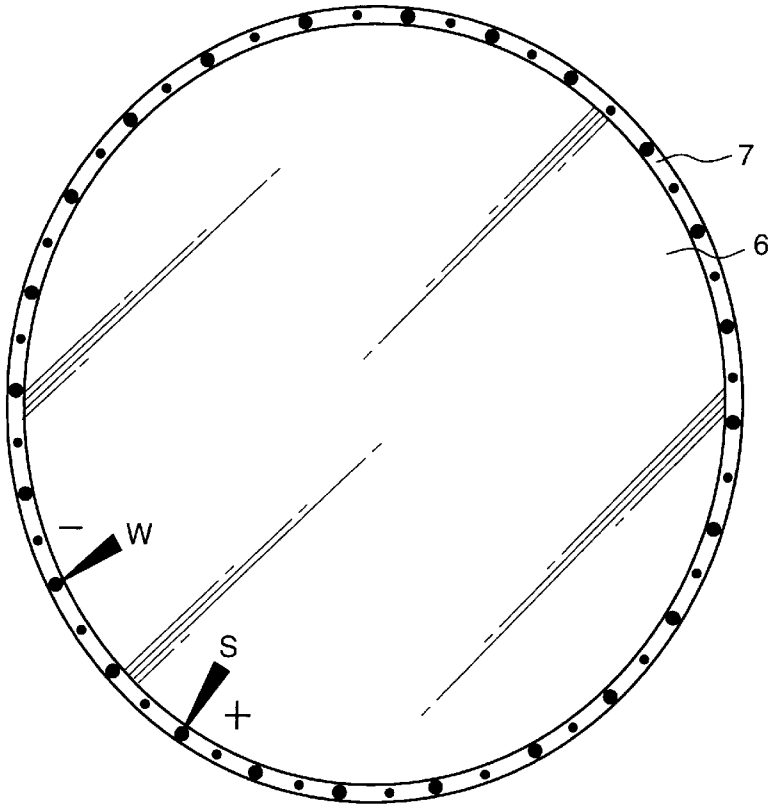
FIG. 5 is a back view of the watch of FIG. 1.

FIG. 5 is a bottom view showing the rear cover, or back, 6 of a watch according to the invention. Resetting the time is performed by turning the rear cover 6. A graduation into time periods is applied to the case 7. Symbols "S" for summer, or daylight savings time, and "W" for winter, or standard time, and the symbols "+" and "−" are applied to the rear cover 6. The symbols "+" and "−" indicate the direction of turning for an adjustment to be made, for example in case of a time change. The rotatability of the rear cover 6 is controlled in a conventional manner by a spring arresting mechanism with teeth.

Resetting the time could also be performed by lifting the rear cover 6 off the case 7, then setting the time, and finally reassembling the rear cover 6 to the case 7.

Figure 6:
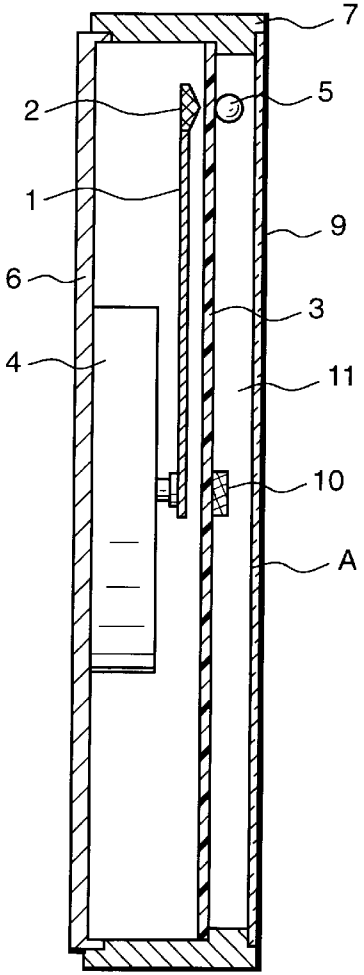
FIG. 6 is a section through a fourth exemplary embodiment of a watch.

FIG. 6 represents a further exemplary embodiment which differs from that of FIGS. 1 and 2 by the provision of at least one further magnet 10 at the center of dial 3. Magnet 10 functions as a reciprocatingly acting element, which attracts the time indicator element 5, which is freely movable in the cage space 11. The magnet 10 can be attached to the underside of the watch glass 9 or underneath the dial. A cover A hides the magnet 10 when it is mounted in cage space 11.

Figure 7:
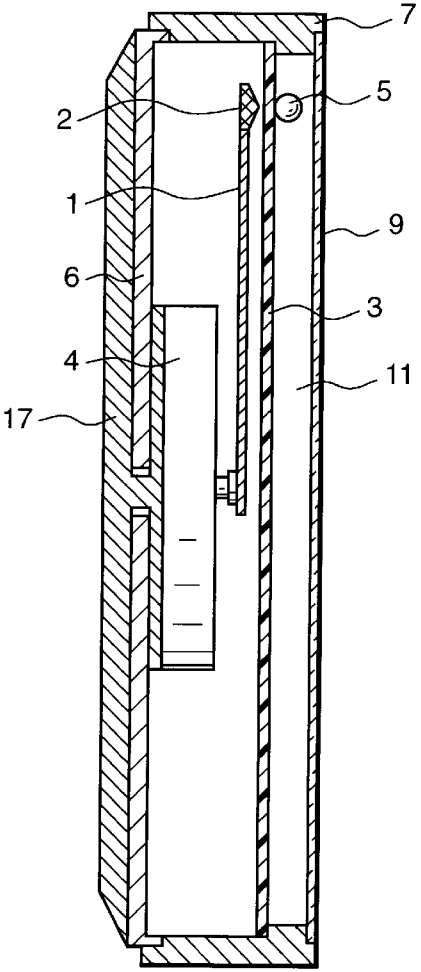
FIG. 7 is a section through a fifth exemplary embodiment of a watch with an adjustment element which can be turned on the back cover.

FIG. 7 represents a section through a further exemplary embodiment, wherein the rear cover 6 has a central bore. A setting element 17 extends through this bore and supports the movement 4. Setting element 17 is assembled with the rear cover 6 and can be rotated relative to rear cover 6.

Figure 8:
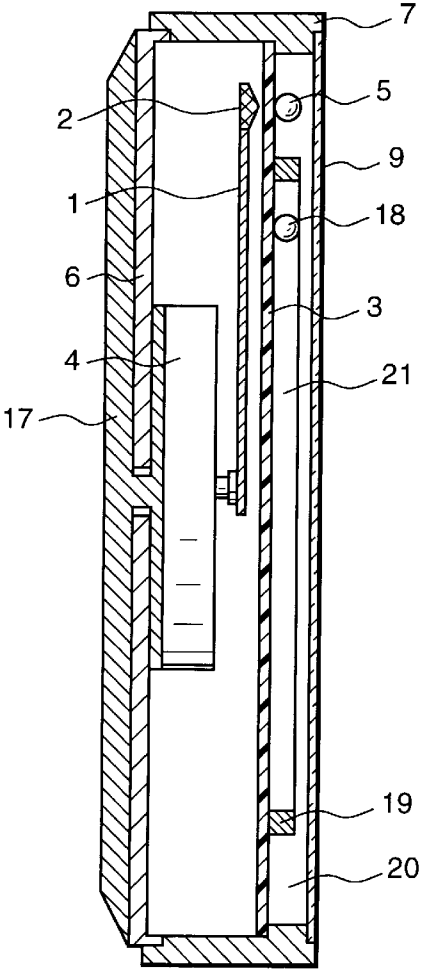
FIG. 8 is a sectional representation of a sixth exemplary embodiment of a watch with two time indicator elements in two cage spaces.

FIG. 8 shows a further exemplary embodiment which differs from that of FIGS. 1 and 2 by the introduction of a second time indicator element 18 and a barrier 19 dividing the cage space into two partial cage spaces 20 and 21. The outer time indicator element 5 is used, for example, for indicating minutes and the inner time indicator element 18 can be used as a movable element without a time indicating function.

In the embodiments shown in FIGS. 1 to 8, the time indicator elements 3 and 5 are in the form of spheres. However, these elements can also be in the form of cylinders.

Figure 9:
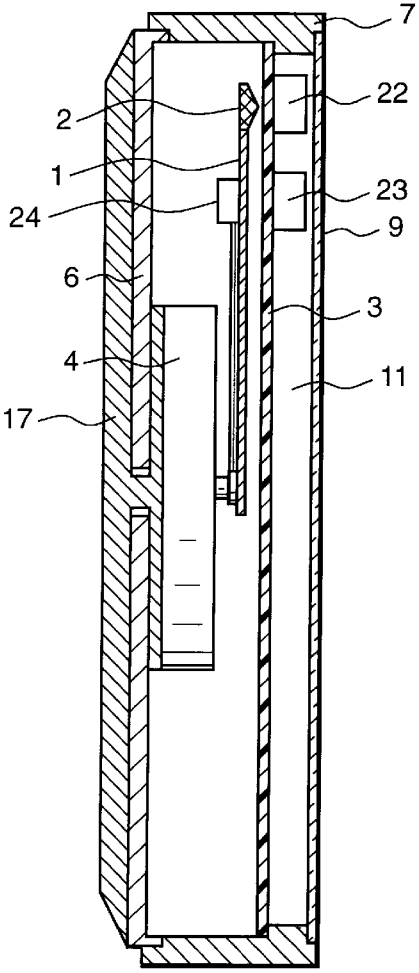
FIG. 9 is a sectional representation of a seventh exemplary embodiment of a watch with two time indicator elements in a common cage space.

FIG. 9 represents a further exemplary embodiment which differs from that of FIGS. 1 and 2 by the provision of a second time indicator element, so that there are two time indicator elements 22 and 23 in the form of discs or cylinders, and by the provision of a further guide element 24 mounted on a further watch hand. The time indicator elements 22 and 23 and the guide elements 2 and 24 are magnets. The guide element 2 is positioned such that for example its positive pole points in the direction of the underside of the dial, while its negative pole points in the direction of the back 6 of the watch case. The guide element 24 is positioned exactly in the reverse. By means of the design of the cage space and the shape of the time indicator elements it is assured that a state where the positive pole of the time indicator element 22 points to the top of the dial and the negative pole of the time indicator element 23 points in the direction of the watch glass 9 does not occur.

Figure 10:
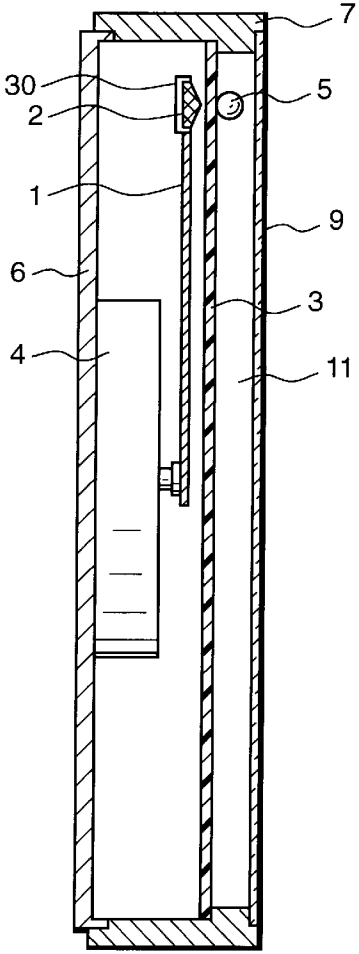
FIG. 10 is a section representation of an eighth exemplary embodiment of a watch.

FIG. 10 shows a further exemplary embodiment which differs from that of FIGS. 1 and 2 by the provision of a partial shell 30 around the guide element 2, guide element 2 being a magnet. Partial shell 30 is a material of high magnetic permeability (for example a super alloy or Mu-metal) and has the purpose of eliminating or reducing the magnetic effects of the guide element 2 on the movement 4.

Figure 11:
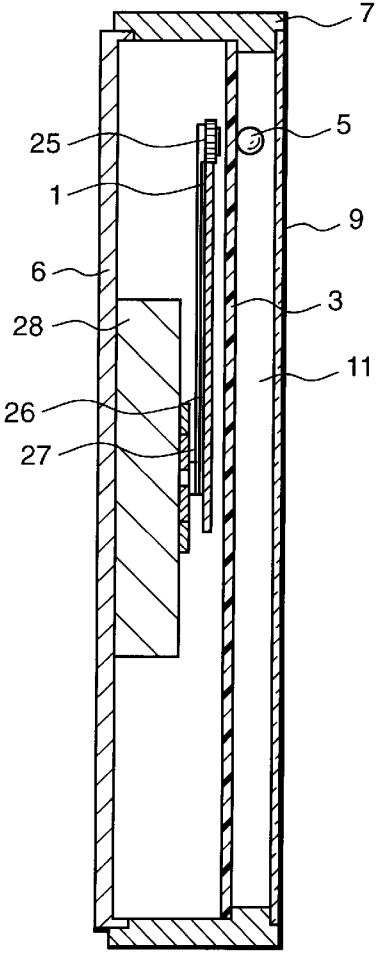
FIG. 11 is sectional representation of a ninth exemplary embodiment of a watch.

FIG. 11 represents a further exemplary embodiment which differs from that of FIGS. 1 and 2 with regard to the structure of the arm 1 which, in FIG. 11, generates the required magnetic force by electromagnetic induction. To this end the arm 1 is provided with a coil 25 having two conductor ends 26 and 27 which are located adjacent the axis of rotation of the arm 1. Current connections are made to conductor ends 26 and 27 by conventional sliding contacts. The battery driving quartz movement 4 is used as the energy source for coil 25.

This application relates to subject matter disclosed in European Application number 97102663.8-2208, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A watch comprising: at least one guide element; at least one time indicator element; and a dial interposed between said at least one guide element and said at least one time indicator element, said at least one guide element being movable as a function of time and said at least one time indicator element being magnetically coupled to said at least one guide element for movement with said at least one guide element to provide a detectable time indication, wherein said watch further comprises means defining a cage space for maintaining said at least one time indicator element secure against loss, and the magnetic coupling between said at least one time indicator element and said at least one guide element extends over at least a partial area of said cage space.

2. The watch in accordance with claim 1, wherein the magnetic coupling is of such a magnitude that said at least one time indicator element can change between a time indicating position and a free movement position inside said cage space under the changing effects of the mechanical and magnetic forces acting on said at least one time indicator element.

3. The watch in accordance with claim 1, wherein there are two said time indicator elements and two said guide elements, each of said guide elements being positively associated with a respective one of said time indicator elements by the type of the effects and/or the range of the effects of the associated magnetic fields and/or the possible movement ranges of the associated time indicator elements being localized in respect to each other.

4. The watch in accordance with claim 1, wherein said cage space is a ring-conduit-shaped cage space (12), which is open at the top, in which space said at least one time indicator element is maintained and guided that the time indicating position of said at least one time indicator element can be tactilely sensed.

5. The watch in accordance with claim 1, wherein said at least one guide element has a pyramid- or spherical shape and has a tip which points toward said at least one time indicator element when said at least one time indicator element is in a time indicating position.

6. The watch in accordance with claim 1, wherein said at least one time indicator element and said at least one guide element contain permanent magnets.

7. The watch in accordance with claim 1, said at least one time indicator element comprises a plurality of elements which cooperate with a common guide element.

8. The watch in accordance with claim 1, further comprising: a watch movement having a center axis and coupled to said at least one guide element; and at least one additional element which reciprocally interacts with said at least one time indicator element and which is maintained stationary on said dial within said cage space and on the center axis of said movement.

9. The watch in accordance with claim 8, further comprising a cover provided above said additional element for concealing said additional element from view.

10. The watch in accordance with claim 1, wherein said at least one time indicator element has the form of a sphere or cylinder.

* * * * *